United States Patent [19]

Dallum et al.

[11] Patent Number: 5,024,342

[45] Date of Patent: Jun. 18, 1991

[54] CORROSION RESISTANT CONTAINERS

[76] Inventors: Barry J. Dallum, 1007 Cheyenne Dr., Montgomery, Tex. 77356; David H. Bartlow, 272 Bellingrath, Conroe, Tex. 77301

[21] Appl. No.: 404,798

[22] Filed: Sep. 8, 1989

Related U.S. Application Data

[63] Continuation of Ser. No. 267,889, Nov. 7, 1988, abandoned.

[51] Int. Cl.[5] ..... B65D 90/02; B65D 25/14

[52] U.S. Cl. ..... 220/468; 428/34.5; 428/36.4; 220/901

[58] Field of Search ..... 220/453, 468, 429, 81 R, 220/901; 428/34.5, 36.4

[56] References Cited

U.S. PATENT DOCUMENTS

| | | | |
|---|---|---|---|
| 2,725,271 | 11/1955 | Cunningham | 220/427 |
| 3,298,345 | 1/1967 | Pratt | 220/901 |
| 3,330,627 | 7/1967 | McCormick | 220/453 |
| 3,412,891 | 11/1968 | Bastone et al. | 220/414 |
| 3,700,512 | 10/1972 | Pearson et al. | 428/34.5 |
| 3,870,588 | 3/1975 | Yamamoto | 220/901 |
| 3,895,159 | 7/1975 | Yoshimura | 220/901 |
| 3,931,908 | 1/1976 | Cheyney | 220/901 |
| 4,004,706 | 1/1977 | Guldenfels | 220/453 |
| 4,368,828 | 1/1983 | Samuel | 220/81 R |
| 4,412,561 | 11/1983 | Sakaguchi et al. | 428/34.5 |
| 4,800,128 | 1/1989 | Schacht | 220/453 |
| 4,821,915 | 4/1989 | Mayer | 220/441 |
| 4,825,687 | 5/1989 | Sharp | 220/444 |
| 4,844,287 | 7/1989 | Long | 220/429 |
| 4,876,124 | 10/1989 | Dallum | 220/468 |

FOREIGN PATENT DOCUMENTS

| | | | |
|---|---|---|---|
| 2658111 | 7/1978 | Fed. Rep. of Germany | 220/429 |
| 8203374 | 10/1982 | PCT Int'l Appl. | 220/453 |

OTHER PUBLICATIONS

Silane Coupling Agents–Edwin P. Plueddemann, Plenum Press, 1982, (Summary submitted Jul. 19, 1990).

Effect of filler-treatment method on composite properties–S. Craig Stafford, Plastic Compounding, Jul./Aug. 1987, pp. 41–49.

*Primary Examiner*—Stephen Marcus

*Assistant Examiner*—S. Castellano

[57] ABSTRACT

A composite wall for storage of organic liquid is disclosed. The wall has an outer layer and the outer layer is a resin that is reinforced with chopped glass strands. The wall has an inner layer that is positioned adjacent the outer layer. The inner layer is in contact with the organic liquid. The inner layer comprises a resin containing an inorganic filler and the inner layer provides an inner surface that is resistant to organic liquids to reduce the effect of the organic liquids on the wall.

5 Claims, 1 Drawing Sheet

CORROSION RESISTANT CONTAINERS

This is a continuation of application Ser. No. 267,889, filed Nov. 7, 1988, now abandoned.

BACKGROUND OF THE INVENTION

The invention relates to chemical storage tanks and piping systems and more particular to such systems that can handle organic chemicals. Chemical storage tanks and piping systems use a laminate with a resin rich layer with a non-reinforcing glass veil on the interior surface that comes into contact with the chemicals. There is a structural portion to the laminate that is comprised of a resin reinforced with glass fibers positioned behind this interior surface. The resin rich layer with the glass veil is used to provide a barrier to prevent chemicals from coming into contact with reinforcing glass fibers that are located in the structural portion of the laminate. The layer of resin is generally not affected by inorganic chemicals and provides a suitable barrier for such chemicals. The resin rich layer is necessary to protect the reinforcing glass fibers in the structural portion of the laminate as the inorganic compounds chemically attack the glass fibers. If the inorganic compounds are allowed to attack the glass fibers this can seriously reduce the strength of the laminate and can result in a failure in the storage tank or piping system.

This type of containment system laminate for inorganic compounds has gained wide acceptance and has also frequently been used in storage tanks and piping systems for organic compounds. However, the organic compounds attack the resin portion of the laminate and do not have any real impact on the reinforcing glass fibers used in the laminate. Accordingly, there is a need in the industry for improved laminates that can be used in storage tanks and piping systems that handle organic compounds.

It is an object of the invention to provide an improved laminate that can be utilized to make storage tanks and piping systems and handle organic compounds.

It is a further object of the invention to provide a laminate having an inner wall formed of a resin containing an inorganic filler. The filler can be mechanically or chemically bonded to the resin.

These and other objects of the invention will become apparent after reviewing the following description of the invention.

SUMMARY OF THE INVENTION

A composite wall for storage of organic liquid is disclosed. The wall has an outer layer and the outer layer is a resin that is reinforced with chopped glass strands. The wall has an inner layer that is positioned adjacent the outer layer. The inner layer is in contact with the organic liquid. The inner layer comprises a resin containing an inorganic filler and the inner layer provides an inner surface that is resistant to organic liquids to reduce the effect of the organic liquids on the wall.

DESCRIPTION OF THE PREFERRED EMBODIMENTS

The invention relates to a glass fiber reinforced plastic underground tank that is used to store organic compounds such as gasoline and alcohol. More particularly, the invention relates to a construction for the wall of the tank having a resinous interior surface containing a filler that improves the resistance of the inner wall to reduce the effect on the inner wall by the organic compounds stored in the tank. The details of the invention will be more readily understood by referring to the attached drawings in connection with the following description.

Figure 1:
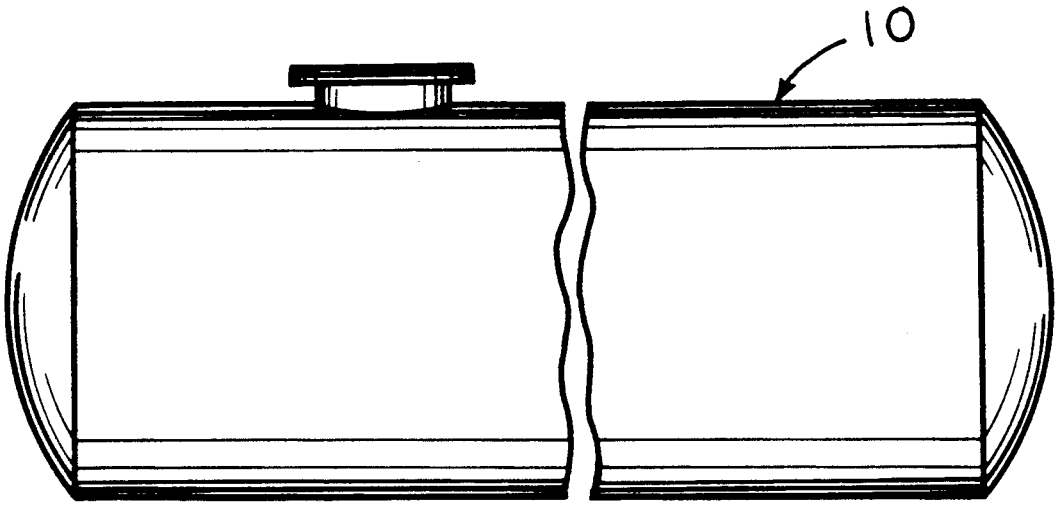
FIG. 1 is a view of an underground tank constructed in accordance with the invention.

FIG. 1 shows a glass fiber reinforced plastic tank 10 constructed in accordance with the invention. Preferably the tank is provided with axially spaced hoop type reinforcing ribs (not shown) such as illustrated on the tank of U.S. Pat. No. 3,700,512. The tank is made in two halves secured together by lay-ups of resin and glass mat, as shown in FIG. 16 of U.S. Pat. No. 3,655,468.

Figure 2:
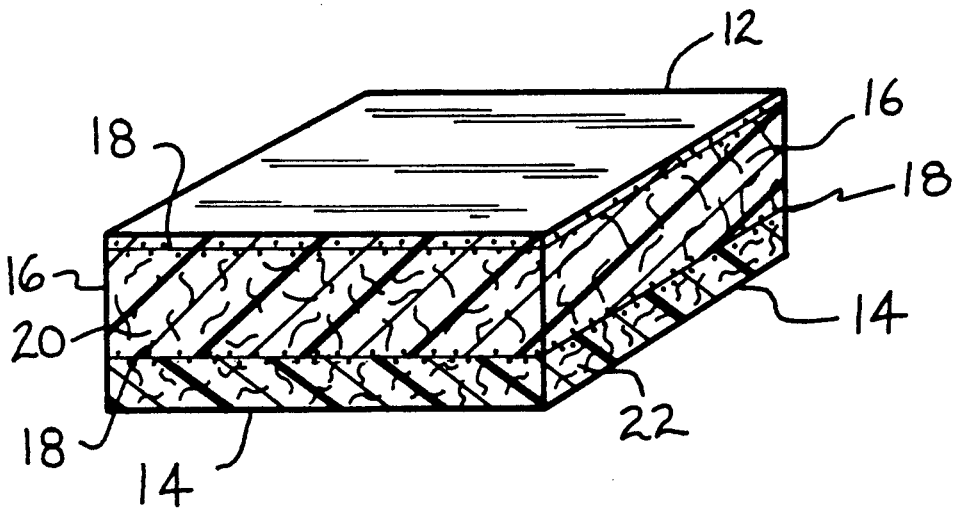
FIG. 2 is an enlarged fragmentary isometric sectional view illustrating the construction of the wall of the tank of FIG. 1.

As shown in FIG. 2, a composite wall section 12 of the tank 10 comprises an inner wall 14 and an structural outer wall 16. The inner wall 14 is made of a resin resistant to corrosion by gasoline or alcohol, such as an unsaturated polyester, vinyl esters, epoxys, polyurethane, and other thermosetting plastics. The structral outer wall 16 comprises either the same plastic as the inner wall or a non-hydrolyzable resin such as a rigid polyvinylchloride, polyethylene, polypropylene, or cross-linked polystyrene with up to 50% of a cross-linking agent such as divinylbenzene, trivinylbenzene, or nitrogen dioxide. A thin non-woven glass fiber surfacing mat 18 can be positioned in the wall section 12 between the inner wall 14 and the outer wall 16. A surfacing mat 18 can also be positioned in the outer wall 16 adjacent the outer surface of the outer wall. In the outer wall 16, the resin is reinforced with chopped glass strand 20.

In the inner wall 14, fillers 22 are added to the resins that form the inner wall. The fillers can be silica, glass fiber strands, mat glass, alumina, calcium carbonate, titanium dioxide, or other inorganic compounds. The particulate fillers may range in size from about 10 microns to about ¼ of an inch. The total filler content in the inner wall 14 can be from about 5% to about 95% by volume. However, it has been found to be preferable to have the fillers 22 constitute at least 25% by volume of the inner wall 14. The fillers 22 may be layers in the inner wall 14 or dispersed homogenously through the inner wall. The layering can be done to produce particular physical properties in the inner wall 14. The fillers 22 can also be mixed where different types of fillers are used and where different sizes of fillers are use. It has also been found to be advantageous to treat the surface of the filler with silane. The silane is designed to chemically react with the resin encapsulating the inorganic material. The silane treatment level can be at any level in water with the water contacting the inorganic material or the silane can be deposited on the inorganic filler by vapor phase contact. The silane can also be added directly to the resin instead of being placed on the filler. The silane can be up to 10% of the resin if this method is used. Other coupling agents and adhesives similar in properties to silane can be used. Examples of alternate treating agents are titanate or zirconate coupling agents. In particular, it has been found that silica and silane treated silica work well as a filler for the resin that comprises the inner wall 14.

Each half of the tank 10 can be formed on a collapsible mandrel, such as disclosed in U.S. Pat. No. 233,020, preferably having integral end caps molded as disclosed in U.S. Pat. No. 4,225,302.

As explained previously, chemical storage tanks and piping systems use a resin with a non-reinforcing glass veil in the interior surface that was in contact with the chemicals. The non-reinforcing glass veil was used as a barrier to protect the reinforcing glass using the structural portion of the laminate from coming into contact with the chemicals. The chemicals that were stored or piped in such systems were normally inorganic chemicals that would attack the glass and once there was serious degradation to the glass there could be a failure in the laminate. However, when organic chemicals such as hydrocabrons and alcohol are stored and piped, the organic chemicals attack the resin instead of the glass. The organic chemicals permeate the resin or are absorbed by the resin and cause the resin to swell. The swelling creates cracks in the laminate and also causes the resin to pull away from the reinforcing glass fibers. The swelling can eventually result in a failure in the laminate.

Fillers 22 used in the resinous material for the inner wall 14 of the present invention are designed to increase the resistance of the inner wall to absorbtion of or permeation by the organic chemicals. It is not completely understood how the fillers 22 interact with the resin to increase the resistance to penetration by organic compounds. However, the organic compounds penetrate or are absorbed by the laminate of the inner wall 14 through the resinous material and this can effect the resin, glass and the resin-glass bond in the laminate. Often the organic compounds permeate the resin, into the spaces between the cross-links, without reacting with the components of the resin. The organic compounds can also travel along the fillers that are present in the inner wall 14 due to small cracks in the resinous material around the filler. However, the fillers 22 are impermeable to the inorganic compounds. Because of the concentration of fillers in the laminate of the inner wall 14, the fillers essentially acts as a barrier that prevents the organic compounds from permeating into the laminate that forms the inner wall 14. As the organic compound attempts to permate the laminate it comes into contact with the impermeable fillers 22 that inhibits the progress of the organic compound into the laminate.

The laminate of the inner wall 14 has less resin by volume percent due to the presence of the fillers 22. Since the resin is the material that absorbs the organic compounds, there is less organic compounds that can be present in the laminate. Even when the resin is saturated with the organic compound there is less organic compound present than in an equal volume of laminate that does not contain the fillers 22. Because there is less organic liquid that can be present in the laminate there is less swelling and less degradation of the laminate.

It is also felt that the laminate of the present invention will have less internal stresses than laminates that do not contain fillers. Residual stresses in glass fiber reinforced plastic are caused mainly by resin shrinkage during curing. If the resin is free to shrink very few residual stresses develop during curing. However, in most applications there is some restraint on the ability of the resin to shrink during curing. In the laminate of the present invention there is less resin present because of the fillers 22 used in the laminate. Further, the resin is restrained from shrinking by the filler in the laminate. By reducing the stresses on the laminate there are fewer cracks or weak spots in the laminate.

It is also felt that the fillers 22 mechanically and/or chemically restrains the resin from swelling thereby reducing internal stresses on the laminate and improving the ability of the laminate to resist organic compounds. When the organic compounds enter the resin in the spaces between the cross-links, more material is present than orginally in the same volume. Pressure is created in the laminate by the organic material and the resin tries to relieve this pressure by expanding. The expansion of the resin creates stresses both in the resin molecules and in the cross-links and allows more organic compound to enter the laminate. Eventually the stress can become great enough to break the resin and the cross-links. The filler provides a resistance to the swelling mechanism and restricts the ability of the laminate to swell. This greatly reduces the internal stresses on the laminate and thereby improves the resistance of the laminate to organic compounds. The controlling of the swelling of the laminate is very significant because organic compounds appear to lower the properties of the resin through an absorption and swelling phenomomen rather than a chemical reaction with the resin.

It should also be noted that the fillers 22 that are used in the inner wall 14 are also less expensive than the resinous material that is used in the inner wall. In addition to improving the resistance of the inner wall to organic compounds the fillers 22 also significantly reduce the cost of the inner wall 14 by replacing a portion of the expensive resin with relatively inexpensive fillers.

The above description is given for the sake of explanation. Various modifications and substitutions, other than those cited, can be made without departing from the scope of the following claims.

We claim:

1. A composite wall adaptable for use in the containment of an organic liquid consisting of:

a structural outer layer composed of a resin reinforced with chopped glass strands; and, an inner layer positioned adjacent said outer layer, said inner layer being in contact with said organic liquid, said inner layer composed of a resin mixed with a surface-modified inorganic filler dispersed homogenously through said inner layer, wherein said filler and said resin are chemically linked to form a barrier to restrict penetration of said organic liquid into said inner layer thereby reducing the effect of said organic liquid on said wall.

2. The wall of claim 1, wherein said filler in said inner layer is silica.

3. The wall of claim 1, wherein said filler in said inner layer is silica surface modified with silane.

4. The wall of claim 1, wherein said filler comprises from about 25% to about 95% by volume of said inner layer.

5. The wall of claim 1, wherein said filler restrains said resin in said inner layer from swelling, thereby reducing internal stresses in said resin and reducing absorption of liquid into said resin.

* * * * *